US007666003B2

(12) United States Patent
Klinger et al.

(10) Patent No.: US 7,666,003 B2
(45) Date of Patent: Feb. 23, 2010

(54) CONTACT DEVICE

(75) Inventors: Herbert Klinger, Nuremberg (DE); Martin Petrzik, Stein (DE); Michael Haug, Vaihingen (DE); Friedbert Roether, Cleebronn (DE); Markus Deeg, Eberdingen (DE)

(73) Assignee: Knorr-Bremse Systeme fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/188,588

(22) Filed: Aug. 8, 2008

(65) Prior Publication Data

US 2009/0029573 A1 Jan. 29, 2009

Related U.S. Application Data

(63) Continuation of application No. PCT/EP2007/000952, filed on Feb. 5, 2007.

(30) Foreign Application Priority Data

Feb. 9, 2006 (DE) ..... 10 2006 005 940

(51) Int. Cl.
*H01R 12/00* (2006.01)

(52) U.S. Cl. ..... 439/74

(58) Field of Classification Search ..... 439/66, 439/67, 74, 77, 474
See application file for complete search history.

(56) References Cited

U.S. PATENT DOCUMENTS

| | | | | |
|---|---|---|---|---|
| 3,213,325 | A | 10/1965 | Lindstrand | |
| 4,949,454 | A | 8/1990 | Schauer et al. | |
| 5,821,465 | A | 10/1998 | Tanaka et al. | |
| 5,860,831 | A | 1/1999 | Roeder et al. | |
| 6,505,402 | B2 * | 1/2003 | Moriwake et al. | 29/883 |
| 6,508,661 | B1 | 1/2003 | Yu | |
| 7,407,379 | B2 * | 8/2008 | Fairy | 425/549 |
| 2002/0142663 | A1 | 10/2002 | Takeyama et al. | |
| 2003/0109170 | A1 * | 6/2003 | Ashiya et al. | 439/474 |

FOREIGN PATENT DOCUMENTS

| | | |
|---|---|---|
| DE | 199 56 750 A1 | 6/2000 |
| DE | 102 50 935 B3 | 8/2004 |
| EP | 0 298 410 A1 | 1/1989 |

OTHER PUBLICATIONS

International Preliminary Report on Patentability (translation) (six (6) pages) May 2, 2007.
International Search Report dated Jun. 11, 2007 with an English translation (Six (6) pages).

* cited by examiner

*Primary Examiner*—Renee Luebke
*Assistant Examiner*—Larisa Tsukerman
(74) *Attorney, Agent, or Firm*—Crowell & Moring LLP

(57) ABSTRACT

A contact device is provided, the device having at least a first contact region for electrical connection to an electric line and at least a second contact region for electrical connection to a flexible printed circuit board other contact medium which may damaged by repeated soldering. The first contact region and the second contact region are electrically connected. Between the first contact region and the second contact region, a third region is provided which has a lower thermal conductivity per unit length than the first contact region and/or the second contact region.

11 Claims, 1 Drawing Sheet

CONTACT DEVICE

CROSS-REFERENCE TO RELATED APPLICATIONS

This application is a Continuation of PCT International Application No. PCT/EP2007/000952, filed on Feb. 5, 2007, which claims priority under 35 U.S.C. §119 to German Application No. 10 2005 005 940.9, filed Feb. 9, 2006, the entire disclosures of which are expressly incorporated by reference herein.

BACKGROUND AND SUMMARY OF THE INVENTION

The invention relates to a contact device with at least a first contact region, which is designed for electrical connection to an electric line, and at least a second contact region, which is designed for electrical connection to a flexible circuit board or some other contact medium which becomes damaged as a result of repeated soldering, the first contact region and the second contact region being connected electrically. The invention also relates to a method of producing an electrical connection between an electric line and a flexible circuit board.

Electrical connections between and within complex subassemblies are increasingly being realized using flexible circuit boards, also referred to as flexible foils. In comparison with electrical cable connections, these have a series of advantages. A flexible circuit board allows good movement of components of the subassemblies in relation to one another, in particular also during fitting. Furthermore, in comparison with conventional cables, a flexible circuit board takes up less space and, at the same time, can be subjected to relatively high mechanical loading. A flexible circuit board is used to connect, for example, various electronic components, such as sensors, actuators, etc., electrically to a control electronics unit. The transition between conventional cable technology and a flexible circuit board takes place, according to the prior art, by a flex or a contact pin being soldered directly onto the flexible circuit board. This method of contact connection has the disadvantage that, in the event of the component which is contact-connected in this way to the flexible circuit board being exchanged, the flexible circuit board may be damaged by soldering heat. It is thus usually only possible for this soldering operation to be easily carried out once, which is disadvantageous in particular in the case of repair or exchange.

The object of the invention is to provide a device and a method which are intended for the contact connection of an electric line and a flexible circuit board or some other contact medium which becomes damaged as a result of repeated soldering, and avoid the abovementioned problems and, in particular in the case of the connection between the device and the electric line being broken and reinstated, avoid damage to the flexible circuit board.

This object is achieved by the features of the independent claims.

Advantageous embodiments of the invention are given in the dependent claims.

The invention builds on the contact device of the generic type by providing, between the first contact region and the second contact region, a third region which has a thermal conductivity per unit length which is lower than the thermal conductivity per unit length of the first contact region and/or the thermal conductivity per unit length of the second contact region. The envisaged third region with a lower thermal conductivity per unit length hinders or slows down the transfer of heat, where a large amount of heat has been supplied at the first contact region, to the second contact region, which is thermally connected to the thermally more sensitive flexible circuit board. In this way, the connection between the first contact region and an electric line can be produced and broken as often as desired even when this operation is associated with a significant temperature rise in the first contact region. In contrast to the prior art, in which there is no provision made to prevent the transfer of heat, or to make it more difficult, the present invention considers, in particular, heat transmission from the one contact region to the other contact region and makes this more difficult using suitable measures. This heat transmission determines a preferred direction, to which the thermal conductivity per unit length is to be referred in particular. The expression thermal conductivity per unit length here is intended to cover those properties of the respective region on which a transfer of the heat between the contact regions depends, for example the spatial configuration, material parameters, etc. Moreover, as a result of the transfer of heat which is applied at the first contact region being made more difficult or slowed down, heat-loss mechanisms such as radiation or convection have a greater effect, and the adverse effect on the second contact region is thus additionally reduced.

In the case of a preferred embodiment, it is provided that the lower thermal conductivity per unit length of the third region is brought about in that the third region has an effective cross section in the heat-transfer direction which is smaller than the effective cross section of the first contact region in the heat-transfer direction and/or the effective cross section of the second contact region in the heat-transfer direction. This constitutes an embodiment which is relatively straightforward to realize in production terms. It is possible here, for example, for the geometrical cross section of the third region to be achieved by a reduction in the circumference, that is to say, for example, by the formation of a tapered portion, of a constriction or the like. As an alternative, it is also possible to reduce the cross section by segmentation in the heat-flow direction, that is to say, for example, by the formation of a plurality of heat-transmission regions with a particularly small cross section, which may be expedient, in particular, from mechanical standpoints.

As an alternative, or in addition, it may be provided, in the case of an advantageous embodiment, that the lower thermal conductivity per unit length of the third region is brought about in that the material of the third region has a lower thermal conductivity per unit length than the materials of the first contact region and/or the second contact region. This embodiment, by providing at least two different materials, means that more stringent requirements have to be met by production, but, if the materials are suitably selected, it can bring about particularly good thermal isolation of the two contact regions.

In the case of a likewise advantageous embodiment, it is provided that the task of connecting the first contact region electrically to the electric line and/or the task of connecting the second contact region electrically to the flexible circuit board comprises at least one soldering operation. The operation of soldering at least one of the two electrical connections of the contact device constitutes a particularly straightforward, cost-effective and reliable connection method.

In particular in the case of an advantageous embodiment, it may be provided that the main directions in which the first contact region and the second contact region are positioned enclose an angle of essentially 90°. Such an arrangement makes it easier, for example, to produce the electrical connection between the electric line and the contact device.

In the case of an advantageous embodiment, it may be provided the first contact region has a contact surface suitable for soldering purposes. This aids the production of the electrical connection between the first contact region and that electric line.

Furthermore, it may advantageously be provided that the contact surface at least partially accommodates the electric line. The soldering operation may thus be facilitated to the extent where the electric line which is to be fitted is introduced into the contact surface prior to the soldering operation and retained there during the soldering operation.

It may also be provided, in the case of a preferred embodiment, that the second contact region is of essentially cuboidal or cylindrical design. This constitutes an easy-to-produce basic shape which is suitable for contact connection to a flexible foil.

It is further advantageous if the contact device has a latching and/or a plug-in portion. This allows straightforward fastening of the contact device, for example, on a carrier which retains the flexible circuit board.

It may likewise preferably be provided that the latching and/or plug-in portion, the first contact region, the second contact region and the third region are connected by a common basic body. It may be advantageous here, in certain circumstances, for the basic body to be of significantly greater dimensions than the third region, and possibly also than the second contact region, in order to achieve sufficient mechanical stability for the device as a whole.

The invention also relates to a method of producing an electrical connection between an electric line and a flexible circuit board, comprising the following steps:

providing a rigid contact device, in particular a contact device according to the invention, connecting a first contact region of the rigid contact device to an electric line, and connecting a second contact region of the rigid contact device to a flexible circuit board.

In the case of a preferred embodiment of the method, it may be provided that the connection comprises at least one soldering operation.

In this way, the advantages of the invention are also realized within the context of a method.

The invention is based on the finding that the cable flex or the pin of an electromechanical component is contact-connected not directly to the flexible foil, but to the one end of a conductive transfer location, of which the other end is contact-connected to the flexible foil. In the case of exchange being necessary, the cable flex or the pin can be detached and attached a number of times, by soldering, without the flexible foil being subjected to loading, or becoming damaged, in the process.

Other objects, advantages and novel features of the present invention will become apparent from the following detailed description when considered in conjunction with the accompanying drawings.

DETAILED DESCRIPTION

The figures use like designations to designate like components, at least some of which, in order to avoid repetition, are explained only once.

Figure 1:
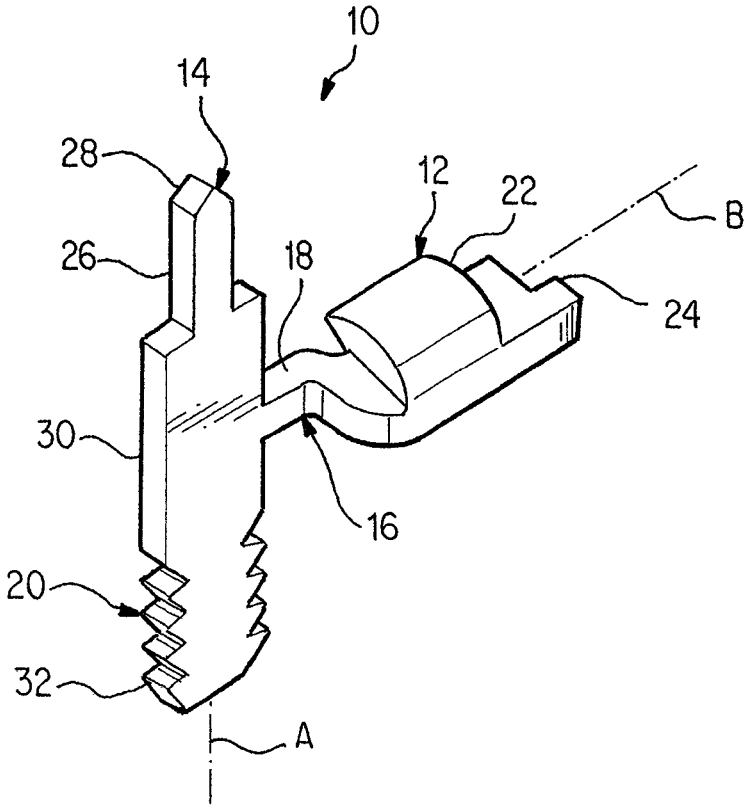
FIG. 1 shows a perspective view of a preferred embodiment of the contact device according to the invention.

FIG. 1 shows a perspective view of a first preferred embodiment of a contact device 10 according to the invention. The contact device 10 can be divided up essentially into four regions. A first contact region 12 has a cable lug 22 which is open on two sides and is integrated in a bearing surface 24 which extends essentially horizontally along the axis B. A second contact region 14 extends along the axis A essentially perpendicularly to this horizontal bearing surface 24 (although any desired or necessary direction would be possible) and is essentially in the form of a vertical cuboid 26, of which the top end 28 terminates in the form of a saddle roof. This second contact region 14 is followed in the downward direction, in vertical extension of the axis A, by the basic body 30 of the contact device 10. This basic body is likewise of cuboidal design. The plug-in portion 20 follows in the downward direction, likewise in vertical extension of the axis A. The plug-in portion 20 has a sawtooth-like structure 32 on two opposite side surfaces extending parallel to the axis A. In the centre of the basic body 30 of the contact device 10 is the transition region 16, which connects the bearing body 24 and the basic body 30. In comparison with a cross section of the basic body 30 in a direction perpendicular to the axis A and with a cross section of the bearing body 24 in a direction perpendicular to the axis B, the transition region 16 has a significantly reduced cross section 18. The bearing body 24 and the soldering lug 22 are provided for accommodating a cable flex or a contact pin (not illustrated). The second contact region 14 is provided for contact connection, for example likewise by soldering, to a flexible circuit board or to some other contact medium which becomes damaged as a result of repeated soldering (and is not illustrated either). The plug-in portion 20 serves for secure and straightforward fastening of the contact device 10 in a holder or carrier, which may possibly likewise carry the flexible circuit board. The entire contact device is produced in one piece from a thermally and electrically conductive material, for example a copper alloy.

The operation of soldering a cable flex or a pin into the soldering lug 22, by its very nature, gives rise to high temperatures. However, in contrast to the cable flex or the pin being soldered directly to a flexible circuit board, these high temperatures are not transferred directly to the flexible circuit board. Rather, thermal transfer is hindered in the transition region 16 as a result of the reduced cross section 18. On the one hand, the transmission of the heat from the bearing body 24 to the contact region 14 is thus slowed down and, on the other hand, a relatively high proportion of heat is lost in the transition region 16. This means that, in the case of a cable flex being attached in the soldering lug 22, or detached from the same, by soldering, the flexible circuit board, which is fastened in the contact region 14, is subjected to thermal loading only to a reduced extent, if at all.

Figure 2:
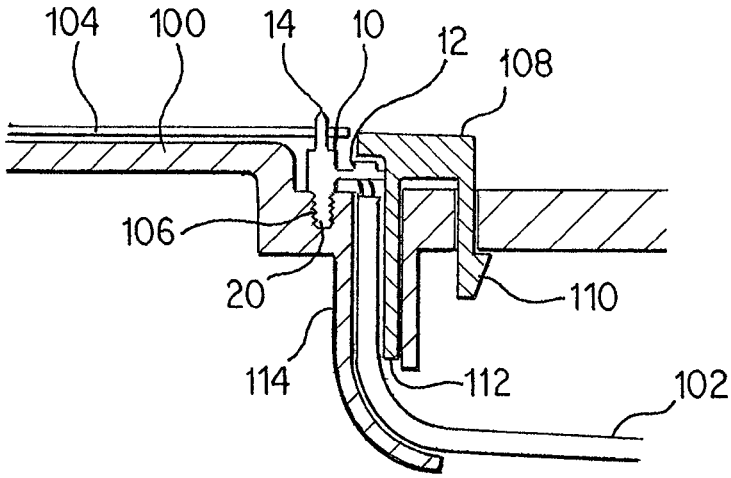
FIG. 2 shows a sectional view of a flexible-foil holder with the preferred embodiment of the contact device according to the invention.

FIG. 2 shows a sectional view of a flexible-foil holder with the preferred embodiment of the contact device according to the invention, the illustration according to FIG. 2 also serving to explain the implementation of the method according to the invention. The flexible-foil holder 100 serves for retaining a flexible foil 104 and, for contact connection according to the invention between the flexible foil 104 and an electric cable 102, accommodates the contact device 10 in a plug-in depression 106. The contact device 10 can be introduced into this plug-in depression 106, and thus fastened on the flexible-foil holder 100, by way of its latching portion 20. This can be aided, as depicted, for example in the case of an appropriately selected combination of materials, by a suitable sawtooth-like outer contouring 32. The electric cable 102 channels, for example, measuring signals for a displacement sensor (not depicted), is connected electrically to the first contact portion 12 of the contact device 10 and, moreover, is fixed, and relieved of strain, via a latching wedge 108. A latching nose 110 here connects the latching wedge 108 to the flexible-foil holder 100 and a wedge-shaped portion 112 clamps the electric cable 102 against a cable guide 114. The second contact portion 14 of the contact device 10 is connected electrically to the flexible foil 104, and this results in an electrical connection being produced between the flexible foil 104 and the electric supply line, in this case the electric cable 102.

The method according to the invention will be explained in more detail hereinbelow. In order to make an electrical connection between the electric cable 102 and the flexible foil 104, the procedure is as follows. First of all, in a first preparatory step, the contact device 10 is plugged into the flexible-foil holder 100. In this way, the contact device 10 is fixed mechanically and the first contact region 12 and the second contact region 14 are easily accessible for soldering purposes. In a next step, the flexible foil 104 is connected to the second contact region 14 by means of a soldering operation. In a subsequent step, the electric cable 102 can then be soldered to the contact device 10, in particular the contact region 12. The order in which the individual steps are carried out is unimportant as far as the concept of the invention is concerned. For example, it is possible for the contact device 10 to be fastened on the flexible-foil holder 100 only once the flexible foil 104 has been soldered to the contact device 10. Furthermore, there is no need for the steps to follow directly one after the other. For example, the steps of fastening the contact device 10 on the flexible foil 104 and of soldering the flexible foil 104 to the contact device 10 may be separated by other steps.

Those features of the invention which are disclosed in the above description, in the drawings and in the claims may be essential both individually and in any desired combination for the purpose of realizing the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF DESIGNATIONS

10 contact device
12 first contact region
14 second contact region
16 transition region
18 cross section
20 latching portion
22 soldering lug
24 bearing body
26 flexible-foil contact pin
28 top end
30 basic body
32 latching means
100 flexible-foil holder
102 electric cable
104 flexible foil
106 plug-in depression
108 latching wedge
110 latching nose
112 wedge-shaped portion
114 cable guide
A axis in the preferred direction of the basic body
B axis in the preferred direction of the bearing body

What is claimed is:

1. A contact device, comprising:
a first contact region configured for electrical connection to an electric line;
a second contact region configured for electrical connection to a flexible circuit board or other contact medium; and
a third contact region between the first contact region and the second contact region,
wherein
the first contact region and the second contact region are connected electrically, and
the third contact region has a thermal conductivity per unit length, in a heat transfer direction between the first contact region and the second contact region, which is lower than at least one of a thermal conductivity per unit length of the first contact region and a thermal conductivity per unit length of the second contact region, and
wherein the lower thermal conductivity per unit length of the third region results from the material of the third region having a lower thermal conductivity per unit length than the material of at least one of the first contact region and of the second contact region.

2. The contact device as claimed in claim 1, wherein
the lower thermal conductivity per unit length of the third region is results from the third region has an effective cross section in the heat transfer direction which is smaller than at least one of the effective cross section of the first contact region in the heat transfer direction and the effective cross section of the second contact region in the heat transfer direction.

3. The contact device as claimed in claim 1, wherein
at least one of the first contact region electrical connection to the electric line and the second contact region electrical connection to the flexible circuit board or other contact medium is a soldered connection.

4. The contact device as claimed in claim 1, wherein
a longitudinal direction of the first contact region and a longitudinal direction of the second contact region are positioned at an angle of essentially 90°.

5. The contact device as claimed in claim 1, wherein
the first contact region has a contact surface suitable for soldering.

6. The contact device as claimed in claim 5, wherein
the contact surface at least partially accommodates the electric line.

7. The contact device as claimed in claim 1, wherein
the second contact region is essentially cuboidal or cylindrical in shape.

8. The contact device as claimed in claim 1, wherein
the contact device has at least one of a latching and a plug-in portion.

9. The contact device as claimed in claim 8, wherein
the at least one of latching and plug-in portions, the first contact region, the second contact region and the third region are connected by a common basic body.

10. A method of producing an electrical connection between an electric line and a flexible circuit board, comprising the acts of:
providing a contact device having
a first contact region configured for electrical connection to an electric line;

a second contact region configured for electrical connection to a flexible circuit board or other contact medium; and a third contact region between the first contact region and the second contact region, wherein the first contact region and the second contact region are connected electrically, the third contact region has a thermal conductivity per unit length, in a heat transfer direction between the first contact region and the second contact region, which is lower than at least one of a thermal conductivity per unit length of the first contact region and a thermal conductivity per unit length of the second contact region and the lower thermal conductivity per unit length of the third region results from the material of the third region having a lower thermal conductivity per unit length than the material of at least one of the first contact region and of the second contact region;

connecting the first contact region of the contact device to an electric line; and connecting the second contact region of the contact device to a flexible circuit board.

11. The method as claimed in claim 10, wherein at least one of the connecting acts includes soldering.

* * * * *